US011761673B2

(12) United States Patent
Zauderer et al.

(10) Patent No.: US 11,761,673 B2
(45) Date of Patent: Sep. 19, 2023

(54) AIR CONDITIONING CORNER DIFFUSER ASSEMBLY

(71) Applicant: ACP Ltd., Yesodot (IL)

(72) Inventors: Ron Zauderer, Petah Tikva (IL); Yehuda Klein, Rehovot (IL)

(73) Assignee: ACP Ltd., Yesodot (IL)

( * ) Notice: Subject to any disclaimer, the term of this patent is extended or adjusted under 35 U.S.C. 154(b) by 242 days.

(21) Appl. No.: 17/021,106

(22) Filed: Sep. 15, 2020

(65) Prior Publication Data

US 2022/0082291 A1 Mar. 17, 2022

(51) Int. Cl.
*F24F 13/072* (2006.01)
*F24F 13/24* (2006.01)
*F24F 13/06* (2006.01)

(52) U.S. Cl.
CPC ..... *F24F 13/072* (2013.01); *F24F 13/24* (2013.01); *F24F 2013/0616* (2013.01); *F24F 2013/242* (2013.01)

(58) Field of Classification Search
CPC .. F24F 13/072; F24F 13/24; F24F 2013/0616; F24F 2013/242; F24F 2013/247; F24F 13/06; F24F 2013/088
USPC ..... 454/301
See application file for complete search history.

(56) References Cited

U.S. PATENT DOCUMENTS 2,239,508 A * 4/1941 Sipp ..... F24F 7/10 55/DIG. 29
2002/0151269 A1* 10/2002 Vernier, II ..... F24F 13/1413 454/304
2017/0276397 A1* 9/2017 Mouratidis ..... F24F 13/08

* cited by examiner

*Primary Examiner* — Avinash A Savani
*Assistant Examiner* — Ryan L Faulkner
(74) *Attorney, Agent, or Firm* — Dekel Patent Ltd.; David Klein

(57) ABSTRACT

An air conditioning diffuser assembly includes an air intake member mounted on an elongate upper member formed with an opening to let air pass through from the air intake member. A corner panel extends at a non-zero angle from the elongate upper member. A first corner mounting panel extends from the corner panel. A second corner mounting panel extends from the elongate upper member. Ends of the first and second corner mounting panels are separated by an elongate gap. A diffuser is mounted inside the air conditioning diffuser assembly. A bottom edge of the diffuser is mounted at a juncture between the corner panel and the first corner mounting panel and a top edge of the diffuser is mounted at a juncture between the elongate upper member and the second corner mounting panel.

8 Claims, 2 Drawing Sheets

AIR CONDITIONING CORNER DIFFUSER ASSEMBLY

FIELD OF THE INVENTION

The present invention generally relates to air conditioners, and more particularly to an air conditioning diffuser assembly for corners, such as between a wall and a ceiling.

BACKGROUND OF THE INVENTION

Ceiling-mounted air diffusers are well known in the prior art. In general, a plenum box or chamber is located above a ceiling of a room (or above a drop ceiling). The air conditioning system causes air to flow from the plenum box through the air diffuser into the room below. Such air diffusers require an air deflection surface appropriately positioned in the path of the airflow so as to be capable of effectively directing the airflow in a lateral outward pattern (having a substantial horizontal directional component) as it enters the room through the discharge opening in the ceiling.

However, there are certain situations where it is desired to mount the air diffuser in a corner, such as between a wall and a ceiling. In such a corner installation, it can be difficult to direct the airflow outwards in an efficient manner to reach all areas of the room.

SUMMARY

The present invention seeks to provide a novel and improved air conditioning diffuser assembly for corners, such as between a wall and a ceiling, as described in detail below. The corner diffuser assembly of the invention efficiently directs the airflow outwards to reach all areas of the room.

There is thus provided in accordance with a non-limiting embodiment of the present invention an air conditioning diffuser assembly including an air intake member mounted on an elongate upper member formed with an opening to let air pass through from the air intake member, a corner panel which extends at a non-zero angle from the elongate upper member, a first corner mounting panel that extends at a non-zero angle from the corner panel, a second corner mounting panel that extends at a non-zero angle from the elongate upper member, wherein ends of the first and second corner mounting panels are separated by an elongate gap, and a diffuser mounted inside the air conditioning diffuser assembly, wherein a bottom edge of the diffuser is mounted at a juncture between the corner panel and the first corner mounting panel and a top edge of the diffuser is mounted at a juncture between the elongate upper member and the second corner mounting panel.

Each of the first and second corner mounting panels may include an elongate rim.

The widths of the corner panel and the elongate upper member may or may not be equal.

The diffuser may be formed with multiple apertures.

A blocking element may be placed on the diffuser and aligned with the opening.

One or more acoustic-damping sheets may be placed on at least one inner surface of the air conditioning diffuser assembly.

BRIEF DESCRIPTION OF THE DRAWINGS

The present invention will be understood and appreciated more fully from the following detailed description, taken in conjunction with the drawings in which.

DETAILED DESCRIPTION

Figure 1:
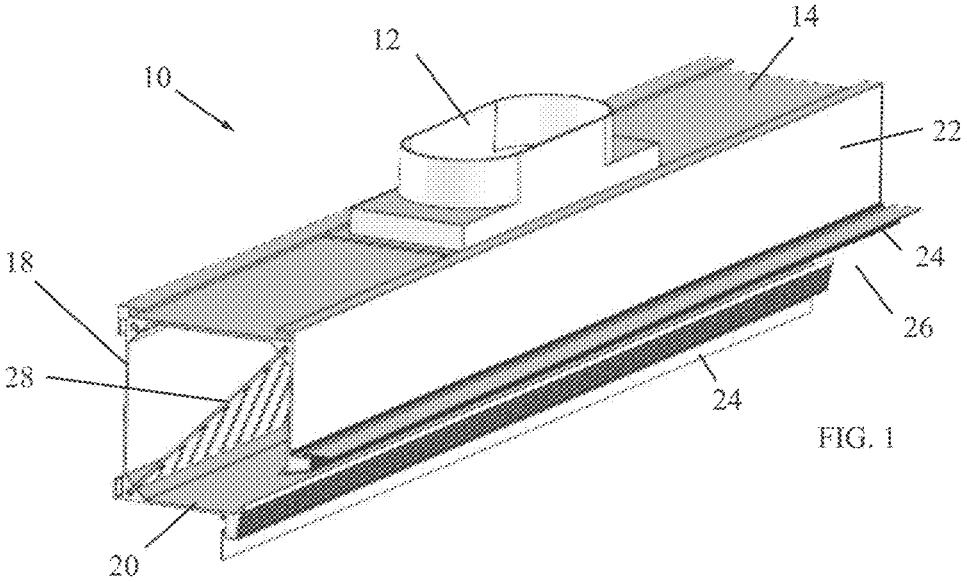
FIG. 1 is a simplified perspective illustration of an air conditioning diffuser assembly, in accordance with a non-limiting embodiment of the present invention.
Figure 2:
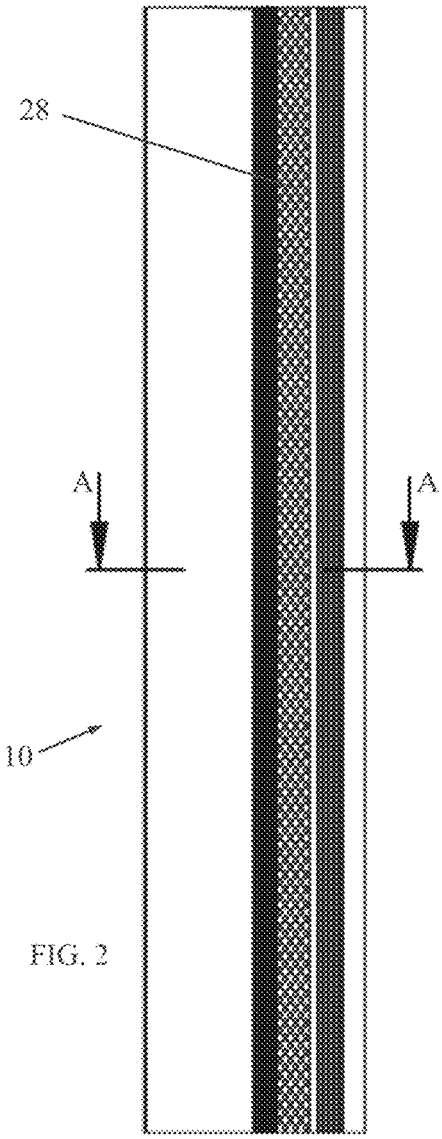
FIGS. 2 and 3 are simplified bottom-view and side-view illustrations of the assembly of FIG. 1.
Figure 3:
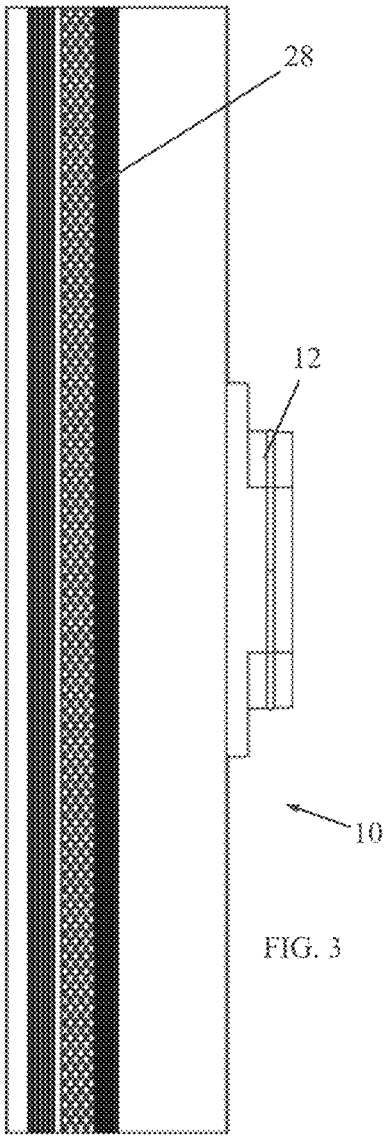

Reference is now made to FIGS. 1-4, which illustrate an air conditioning diffuser assembly 10, constructed and operative in accordance with a non-limiting embodiment of the present invention.

The air conditioning diffuser assembly 10 includes an air intake member 12, which may be oval or other shapes. Air intake member 12 may be connected to a plenum box or chamber (not shown) so that an air conditioning system (not shown) causes air to flow from the plenum box through the air diffuser assembly 10 into a room. Air intake member 12 is mounted on an elongate upper member 14 formed with an opening 16 (FIG. 4) to let the air pass through from air intake member 12.

The air conditioning diffuser assembly 10 includes a corner panel 18 which extends at a non-zero angle from elongate upper member 14. For a right-angle corner, corner panel 18 is perpendicular to elongate upper member 14. A first corner mounting panel 20 extends at a non-zero angle (such as 90°) from corner panel 18. A second corner mounting panel 22 extends at a non-zero angle (such as 90°) from elongate upper member 14, and may be parallel to corner panel 18. Each of the first and second corner mounting panels 20 and 22 may have an elongate rim 24, typically but not necessarily, perpendicular thereto.

The ends or rims of first and second corner mounting panels 20 and 22 are separated by an elongate gap 26. Air flow to the room passes through gap 26.

A diffuser 28 is mounted inside air conditioning diffuser assembly 10. A bottom edge of diffuser 28 is mounted at the juncture between corner panel 18 and first corner mounting panel 20. A top edge of diffuser 28 is mounted at the juncture between elongate upper member 14 and second corner mounting panel 22. If the widths of corner panel 18 and elongate upper member 14 are equal, then diffuser 28 is mounted at a 45° angle. If the widths of corner panel 18 and elongate upper member 14 are not equal, then diffuser 28 is mounted at other acute angles.

Figure 4:
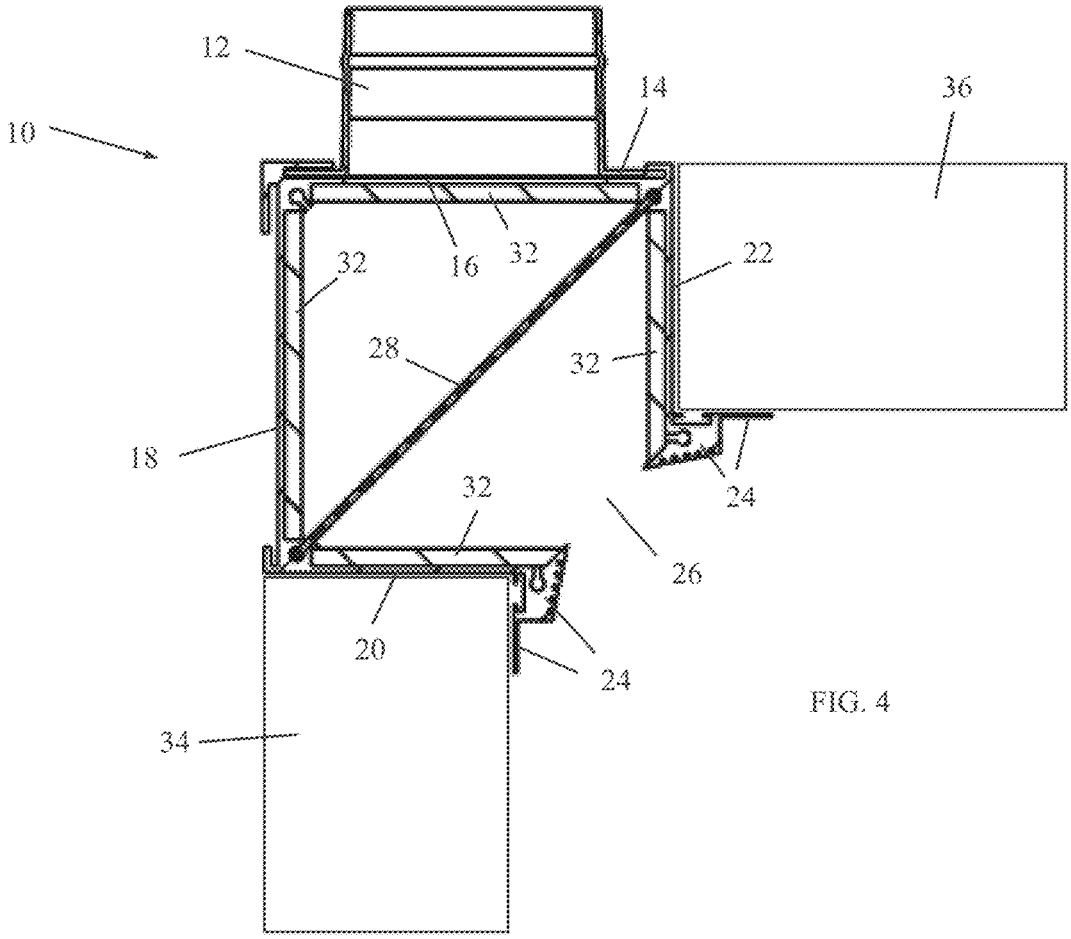
FIG. 4 is a sectional illustration of the assembly taken along lines A-A in FIG. 2 and installed in a corner between a wall and a ceiling.
Figure 5:
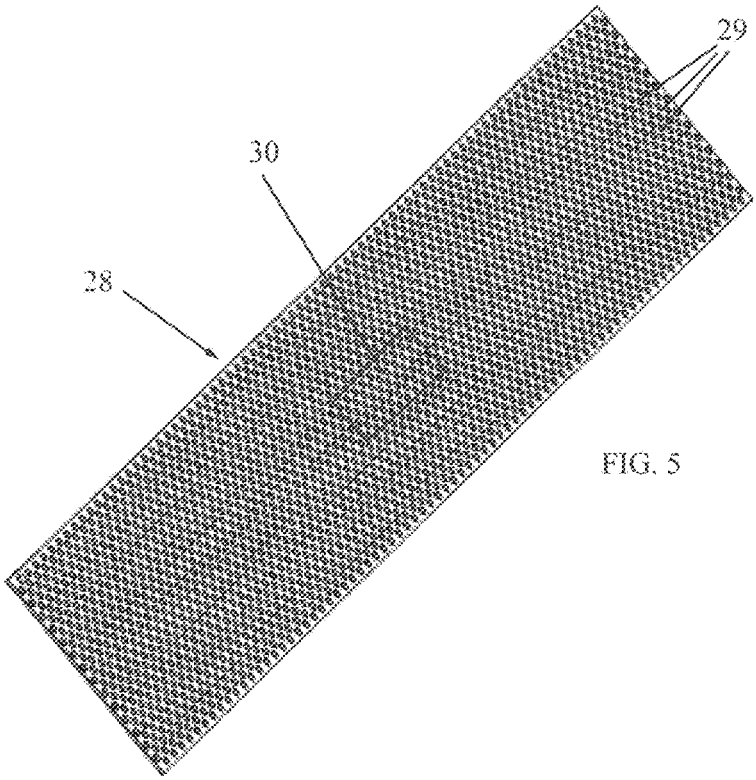
FIG. 5 is a simplified pictorial illustration of a diffuser of the assembly.

As seen in FIG. 5, diffuser 28 may be made of metal, plastic or other materials, perforated or otherwise formed with multiple apertures 29. A blocking element 30 (shown in FIG. 5) may be placed on diffuser 28 aligned with opening 16 (FIG. 4) so that air entering air intake member 12 does not pass straight out through apertures 29 but instead is deflected laterally over the length of diffuser 28 and then exits through the elongate gap 26, and is thus distributed uniformly to all parts of the room.

As seen in FIG. 4, the air conditioning diffuser assembly 10 may include one or more acoustic-damping sheets 32, which may be made of without limitation, from cross-linked, closed-cell polyethylene foam (XLPE). For example, acoustic-damping sheets 32 may be placed along portions of inner surfaces of elongate upper member 14 (without blocking opening 16), corner panel 18 and first and second corner mounting panels 20 and 22.

As seen in FIG. 4, the air conditioning diffuser assembly 10 may be mounted by affixing first and second corner mounting panels 20 and 22 respectively on a wall 34 and in abutment with a ceiling beam or other ceiling member 36, such as by mechanical fasteners, adhesives or dry wall materials.

What is claimed is:

1. An air conditioning diffuser assembly comprising:

an air intake member mounted on an elongate upper member formed with an opening to let air pass through from said air intake member;

a corner panel which extends at a non-zero angle from said elongate upper member;

a first corner mounting panel that extends at a non-zero angle from said corner panel;

a second corner mounting panel that extends at a non-zero angle from said elongate upper member, wherein ends of said first and second corner mounting panels are separated by an elongate gap; and a diffuser formed with apertures and mounted inside said air conditioning diffuser assembly, wherein a bottom edge of said diffuser is mounted at a juncture between said corner panel and said first corner mounting panel and a top edge of said diffuser is mounted at a juncture between said elongate upper member and said second corner mounting panel; and a blocking element, which blocks air from flowing therethrough and which has a length that extends between two opposing ends of said blocking element, said length of said blocking element extending over a portion of a length of said diffuser, said diffuser being located on a plane and said blocking element being on said plane, said blocking element being coupled to said diffuser and aligned with said opening, said blocking element configured to block air from flowing directly from said opening to said diffuser and to deflect the air over the length of said blocking element towards both of said ends of said blocking element, and wherein the air is deflected laterally over the length of said diffuser and then passes through said apertures and exits through said elongate gap.

2. The air conditioning diffuser assembly according to claim 1, wherein said corner panel is perpendicular to said elongate upper member.

3. The air conditioning diffuser assembly according to claim 1, wherein said second corner mounting panel is parallel to said corner panel.

4. The air conditioning diffuser assembly according to claim 1, wherein each of said first and second corner mounting panels comprises an elongate rim.

5. The air conditioning diffuser assembly according to claim 1, wherein widths of said corner panel and said elongate upper member are equal.

6. The air conditioning diffuser assembly according to claim 1, wherein widths of said corner panel and said elongate upper member are not equal.

7. The air conditioning diffuser assembly according to claim 1, wherein one or more acoustic-damping sheets is placed on at least one inner surface of said air conditioning diffuser assembly.

8. A method for air conditioning diffusion comprising:

providing an air intake member mounted on an elongate upper member formed with an opening to let air pass through from said air intake member;

providing a corner panel which extends at a non-zero angle from said elongate upper member;

providing a first corner mounting panel that extends at a non-zero angle from said corner panel;

providing a second corner mounting panel that extends at a non-zero angle from said elongate upper member, wherein ends of said first and second corner mounting panels are separated by an elongate gap; and providing a diffuser formed with apertures and mounted inside said air conditioning diffuser assembly, wherein a bottom edge of said diffuser is mounted at a juncture between said corner panel and said first corner mounting panel and a top edge of said diffuser is mounted at a juncture between said elongate upper member and said second corner mounting panel; and providing a blocking element which blocks air from flowing therethrough and which has a length that extends between two opposing ends of said blocking element, said length of said blocking element extending over a portion of a length of said diffuser, said diffuser being located on a plane and said blocking element being on said plane, said blocking element being coupled to said diffuser and aligned with said opening so when in use said blocking element blocks air from flowing directly from said opening to said diffuser and deflects the air over the length of said blocking element towards both of said ends of said blocking element, wherein the air entering said air intake member does not pass straight out through said apertures but instead is deflected laterally over a length of said diffuser and then passes through said apertures and exits through said elongate gap.

* * * * *